United States Patent [19]

Radkowski

[11] Patent Number: 5,009,729

[45] Date of Patent: Apr. 23, 1991

[54] MATCH HEAD COMPOSITION AND METHOD OF MAKING SAME

[76] Inventor: Stanley J. Radkowski, 7 Katie Dr., Wilbraham, Mass. 01095

[21] Appl. No.: 600,742

[22] Filed: Oct. 22, 1990

[51] Int. Cl.[5] ..... D03D 23/00

[52] U.S. Cl. ..... 149/109.4; 149/109.6

[58] Field of Search ..... 149/109.4, 109.6

[56] References Cited

U.S. PATENT DOCUMENTS 3,650,712 3/1972 Martin et al. ..... 149/19.91

4,060,434 11/1977 Lanham et al. ..... 149/2

4,136,770 1/1979 Cohn ..... 149/4

4,540,419 9/1985 Lanham et al. ..... 149/85

*Primary Examiner*—Stephen J. Lechert, Jr.

*Attorney, Agent, or Firm*—Fishman, Dionne & Cantor

[57] ABSTRACT

A match head composition and method of making same wherein the binder of the pyrotechnic mixture is an animal glue or colored gelatin which is cross-linked and/or bleached in situ by the addition of sodium dithionite and/or a dialdehyde and/or dichromate to said mixture.

14 Claims, No Drawings

MATCH HEAD COMPOSITION AND METHOD OF MAKING SAME

BACKGROUND OF THE INVENTION

This invention relates to a method of producing improved match head compositions and the resulting compositions per se. In particular it relates to the in-situ bleaching and curing, i.e. cross-linking, of animal glues or colored gelatins employed as binders in match head compositions.

Match head compositions are generally characterized as pyrotechnic mixtures of an igniting agent, combustible material, a binder and various amounts of other ingredients such as oxidizers, fillers, dispersants, colorants, etc. While all the major ingredients of said compositions are considered important, the binder or glue which holds the mixture together has always been considered one of the more important and complex parts of a match head composition. Not only does the binder hold the mixture together, it also contributes to the stability of the wet match head compositions and the hardness and moisture resistance of the final match head.

Traditionally, the binder or adhesive used in match head compositions has been a collagen known as animal hide glue. While there are many grades of animal hide glues, the higher quality glues, i.e. the more expensive glues, are predominant in that they possess the higher molecular weights and viscosities which result in better adhesive properties. By employing an in-situ procedure for bleaching and curing, all animal glues, including hide glue and bone glue, achieve a higher molecular weight and increased viscosity thus permiting the use of colored gelatin which is a by-product of the manufacture of gelatin medicine capsules.

Accordingly, it is an object of the present invention to provide a match head composition which is improved by the use of in-situ processing-enhanced animal glues or colored gelatin which improves the physical and chemical properties to the pyrotechnic mixture.

It is another object of the present invention to provide a method of bleaching or bleaching and cross-linking animal glues or colored gelatin in situ so as to provide a pyrotechnic mixture of improved physical and chemical properties.

It is a further object of the present invention to provide a match head composition with no or reduced levels of potentially environmentally hazardous cross-linking agents such as hexavalent chromium ions, i.e. potassium dichromate.

It is a further object of the present invention to reduce the hexavalent chromium ion to the trivalent chromium ion in situ through the addition of sodium dithionite. Said trivalent chromium ion is a cross-linking agent for animal glues and colored gelatin.

Other objects and advantages of the present invention will become more apparent when considered in light of the following discussion.

SUMMARY OF THE INVENTION

In accordance with the present invention an improved match head composition is provided even when using a low quality animal glue or colored gelatin as a binder wherein the glue or colored gelatin is bleached, or bleached and cross-linked in situ via the addition of sodium dithionite, a dialdehyde and/or a dichromate to the pyrotechnic mixture. The simultaneous in-situ bleaching and cross-linking of the animal glue or colored gelatin enhances the overall physical and chemical properties of the pyrotechnic mixture without degradation of the properties or function of the animal glue or colored gelatin per se.

As noted above, the method of the present invention includes (1) the in-situ bleaching of animal glue or colored gelatin with sodium dithionite, (2) the in-situ bleaching and cross-linking of animal glue or colored gelatin with dichromates, (3) the in-situ bleaching and cross-linking of animal glue or colored gelatin with dialdehydes and/or (4) the in-situ bleaching of animal glue or colored gelatin with dialdehydes and dichromates.

As those skilled in the art will recognize, typical match head compositions which employ high quality animal glue as a binder almost invariably use excess amounts of potassium dichromate or equivalent dichromates as a cross-linking agent for the animal glue, i.e. a soluble protein product. Said dichromates, which generate hexavalent chromium ions and subsequently small amounts of trivalent chromium ions, are usually employed in amounts of from 0.3% to 1.0% on a dry solids basis and thus create environmentally hazardous compositions containing hexavalent chromium ions. When dialdehydes such as glutaraldehyde, succinic dialdehyde, etc. are used in amounts of from 0.002% to 0.01% either alone or in conjunction with minor amounts of the chromium compounds, the use of dichromates is either eliminated or at the least reduced to a level of less than 0.2% dry weight basis. As will be clear to those skilled in the art, the lower the level of dichromates present in the pyrotechnic mixture, the lower the level of hexavalent chromium ions which must be reduced to the ecologically safer trivalent chromium ions. This reduction is occasioned by the presence of sodium dithionite in amounts of from about 0.02% to 0.1% dry weight basis which also bleaches the animal glue or colored gelatin binder.

A theoretical explanation of the above in-situ reactions is as follows: Gelatin (or animal glue) is a soluble protein product which is obtained by the hydrolysis of collagen.

$$C_{102}H_{149}O_{38}N_{31} + H_2O \xrightarrow{\Delta} C_{102}H_{151}O_{39}N_{31}$$

Further hydrolysis of the animal glue (gelatin) results in the formation of α-amino acids which have the general formula

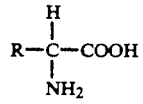

and are the foundation of proteins. Complete hydrolysis or chemical degradation of gelatin can result from high temperature storage and/or bacteriological action.

In the method of the present invention, trivalent chromium ions cross-link the carboxyl ion on the α-amino protein while the dialdehydes cross-link the amino groups. Said cross-linking results in higher molecular weight and increased viscosities. This in-situ cross-linking decreases the risk of degradation by creating numerous combinations of different types of polymers similar to protein. For example, two amino acids can form a dipeptide.

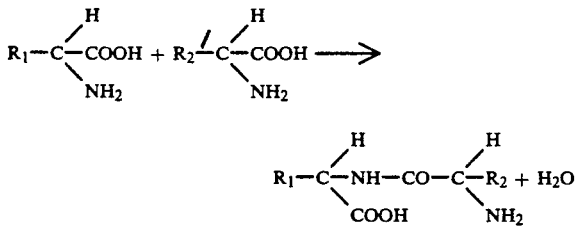

In that the most abundant amino acid in animal glue is gylcine, $H_2N—CH_2—COOH$, the addition of an aldehyde results in a first step to an intermediate product belonging to the Schiff's base family, i.e.

$$R_1—CHO + R_2CH_2N_2 \longrightarrow R_1CH{=}NCH_2R_2 + H_2O$$

(Schiff's base)

The addition of a dialdehyde, such as succinic dialdehyde or glutaraldehyde reacts with two protein molecules, i.e.

$$R_1CH_2NH_2 + OHC—(CH_2)_2—CHO + H_2N—CH_2—R_2 \rightarrow R_1CH_2N{=}CH—(CH_2)_2—CH{=}NCH_2R_2 + H_2O$$

At this point, the addition of sodium dithionite ($Na_2S_2O_4$) to the in-situ process results in reduction of the Schiff base; i.e.

$$S_2O_4^{2-} + 4H_2O \rightarrow 2SO_4^{2-} + 8H^+ + 6e^-$$

$$R_1CH_2N{=}CH(CH_2)_2—CH{=}NCH_2R_2 + 4H^+ + 4e^- \rightarrow R_1CH_2NH(CH_2)_4NHCH_2R_2$$

and $$3R_1CH_2N{=}CH(CH_2)_2CH{=}NCH_2R_2 + 2S_2O_4^{2-} + H_2O \rightarrow 3R_1CH_2NH(CH_2)_4NHCH_2R_2 + 4SO_4^{2-} + 4H^+$$

As will be noted, the Schiff bases are converted to secondary aminos which are very stable. Therefore, it is clear that the sodium dithionite enhances the cross-linking process of the dialdehydes. In addition, the dithionite, during the bleaching of the gelatin (animal glue), reduces the hexavalent chromium ions which may be present, i.e.

$$Cr_2O_7^{2-} + 14H^+ + 6e^- \rightarrow 2Cr^{3+} + 7H_2O$$

$$S_2O_4^{2-} + 4H_2O \rightarrow 2SO_4^{2-} + 8H^+ + 6e^-$$

$$Cr_2O_7^{2-} + S_2O_4^{2-} + 6H^+ \rightarrow 2Cr^{3+} + 2SO_4^{2-} + 3H_2O$$

As trivalent chromium ions exist in aqueous solutions in the form of aqua complexes, e.g. $Cr(H_2O)_6^{3+}$, mononuclear chromium complexes can combine into polynuclear complexes whereby the chromium ions are held together by hydroxyl bridges, i.e.

$$(H_2O)_3Cr(CH)_3Cr(OH)_3Cr(OH)_3—$$

Consequently, the in-situ cross-linking of the gelatin or animal glue is a result of the irreversible occurrence of polychromic complexes in the proteins and the coordinative bonding of the trivalent chromium ions by removing the weaker bonded OH and $H_2O$ ligands, i.e.

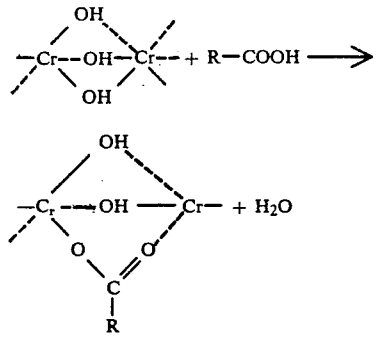

where the dashed lines represent hydrogen bonds.

While a preferred embodiment has been described herein, various modifications and substitutions may be made thereto without departing from the spirit and scope of the invention. Accordingly, it is to be understood that the present invention has been described by way of illustration and not limitation.

What is claimed is:

1. A match head composition comprising a pyrotechnic mixture of an igniting agent, combustibles, oxidizers, fillers and an animal glue or colored gelatin binder, the improvement which comprises the addition of sodium dithionite and a cross-linking agent selected from the group consisting of dichromates, dialdehydes or a mixture of both to said mixture.

2. The match head composition of claim 1 wherein said cross-linking agent is a dialdehyde.

3. The match head composition of claim 1 wherein said cross-linking agent is a dichromate.

4. The match head composition of claim 2 wherein said dialdehyde is succinic dialdehyde or glutaraldehyde.

5. The match head composition of claim 3 wherein said dichromate is potassium dichromate.

6. The match head composition of claim 2 wherein said sodium dithionite is present in an amount of from about 0.02% to about 0.1% dry solids basis and said dialdehyde is present in an amount of from about 0.002% to about 0.01% dry solids basis.

7. A method of making an improved match head composition from a pyrotechnic mixture comprising an igniting agent, combustibles, oxidizers, fillers and an animal glue or colored gelatin binder said improvement comprising bleaching said animal glue or colored gelatin binder in situ with sodium dithionite.

8. A method of making an improved match head composition from a pyrotechnic mixture comprising an igniting agent, combustibles, oxidizers, fillers and an animal glue or colored gelatin binder said improvement comprising cross-linking and bleaching said animal glue or colored gelatin binder in situ with sodium dithionite and a cross-linking agent selected from the group consisting of dichromates, dialdehydes or a mixture of both.

9. The method of claim 8 wherein said cross-linking agent is a dialdehyde.

10. The method of claim 8 wherein said cross-linking agent is a dichromate.

11. The method of claim 9 wherein said dialdehyde is succinic dialdehyde or glutaraldehyde.

12. The method of claim 10 wherein said dichromate is potassium dichromate.

13. The method of claim 8 wherein said sodium dithionite is present in said mixture in an amount of from about 0.02% to about 0.1% dry solids basis and said cross-linking agent is a dialdehyde and present in said mixture in an amount of from about 0.002% to about 0.01% dry solids basis.

14. A method of making an improved match head composition from a pyrotechnic mixture comprising an igniting agent containing potassium dichromate, combustibles, oxidizers, fillers and an animal glue or colored gelatin binder, said improvement comprising cross-linking and bleaching said binder and complexing hexavalent chromium ions in situ by the addition of sodium dithionite and a dialdehyde to said mixture.

* * * * *